United States Patent [19]

Lübnitz

[11] 4,373,226

[45] Feb. 15, 1983

[54] CLEANING DEVICE FOR A HUNG FABRIC

[76] Inventor: Klaus Lübnitz, Borsigstr. 8, 3180 Wolfsburg 1, Fed. Rep. of Germany

[21] Appl. No.: 298,950

[22] Filed: Sep. 3, 1981

[30] Foreign Application Priority Data

Sep. 12, 1980 [DE] Fed. Rep. of Germany ..... 3034399

[51] Int. Cl.[3] ..... A47L 5/38

[52] U.S. Cl. ..... 15/302; 15/320; 68/205 R

[58] Field of Search ..... 15/302, 320, 321, 314; 68/200, 205 R

[56] References Cited

U.S. PATENT DOCUMENTS

| | | | |
|---|---|---|---|
| 2,384,458 | 9/1945 | Dubay | 15/321 X |
| 2,497,435 | 2/1950 | Branneman | 15/321 X |
| 2,881,463 | 4/1959 | Vogel | 15/302 |
| 3,222,895 | 12/1965 | Sheppard | 68/205 X |
| 3,849,831 | 11/1974 | DeVerter et al. | 15/302 |
| 4,161,802 | 7/1979 | Knight et al. | 15/322 X |

*Primary Examiner*—Chris K. Moore

*Attorney, Agent, or Firm*—Brumbaugh, Graves, Donohue & Raymond

[57] ABSTRACT

A cleaning device for hung fabric and the like comprises a pair of adjacent cleaning flaps, each having a fluid distribution chamber formed by the outer and inner walls of the respective flap. The flaps are mounted on a vertically adjustable support column and pivot between an open position and a closed position in which the flaps are folded together to define a cleaning chamber which tightly retains the fabric between the flaps. Each distribution chamber communicates, through pairs of fluid delivery lines, selectively with a source of vacuum or with sources of water or a cleaning fluid, and fluids are delivered to or discharged from the fabric through nozzles.

15 Claims, 6 Drawing Figures

CLEANING DEVICE FOR A HUNG FABRIC

BACKGROUND OF THE INVENTION

The invention relates to a device for the cleaning of fabrics, particularly curtains, drapes and the like, while still hanging.

In the past, the cleaning of large curtains, drapes and the like has largely been impractical. Conventional cleaning apparatus have been of limited size, and have necessitated taking the curtains down, separating the curtains into individual fabric webs and cleaning them, and subsequently reassembling and rehanging them. Because removing large curtains is usually quite expensive, the curtains often are not cleaned at all, and are replaced once they have been "eaten up" and destroyed by dust.

SUMMARY OF THE INVENTION

In accordance with the present invention, two double walled cleaning flaps are mounted on a vertically adjustable support column for pivotal movement about a vertical hinge pin between open and closed positions. The pivoting movement may be accomplished by conventional hydraulic cylinder-and-piston devices attached to an arm mounted transversely to the vertical support column.

The inner walls of the flaps have a series of holes which function as nozzles. The outer walls have a trapezoid-type shape in cross section to form, with the inner walls, a pair of distribution chambers.

This distribution chambers are connected via a plurality of pairs of delivery lines to water, lye and chemical cleaning fluid storage tanks. The distribution chambers are connected by another pair of delivery lines to a common return line via a three-position multipath valve. The common return line is connected to a second valve which selectively connects the common return line to a vacuum source, or the appropriate return lines to the various storage tanks.

During operating states when it is desirable to supply suction, as described below, the second valve is controlled so as to connect the vacuum source to the common return line. The multipath valve may be controlled to connect the vacuum source to either or both of the flaps via the pair of delivery lines. When the vacuum source is applied to only one flap via one line, the multipath valve vents the other line to the atmosphere.

During other operating states, the second valve disconnects the vacuum source and connects the common line to the return line of one of the fluid sources. Water, lye or chemical cleaning fluid is pumped to the flaps through respective valves that may have constructions similar to the multipath valve discussed above, and returned from the flaps through the multipath valve and common return line to their respective tanks for recirculation.

For a better understanding of the invention, reference is made to the following description of a preferred embodiment, taken in conjunction with the accompanying drawings, and its scope will be pointed out in the appended claims.

DETAILED DESCRIPTION OF A PREFERRED EMBODIMENT

Figure 1:
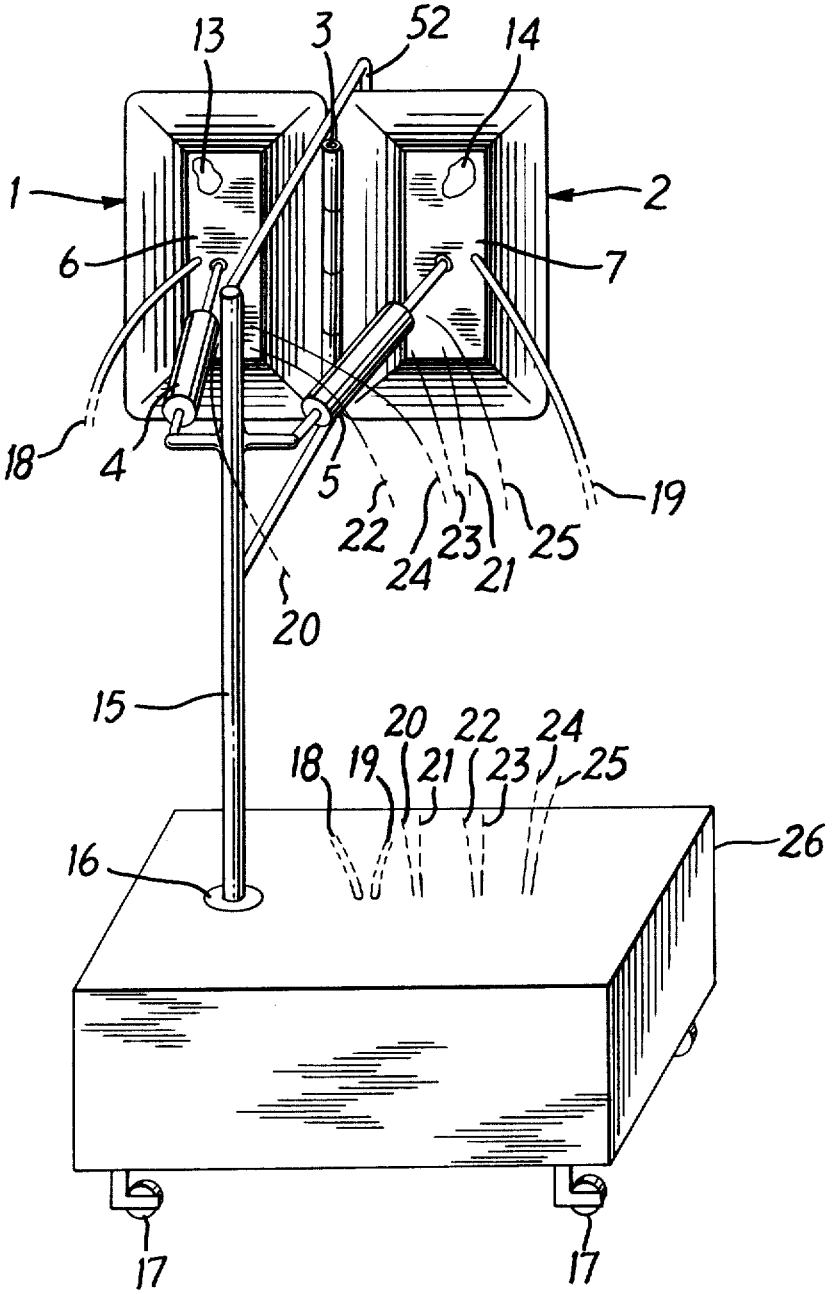
FIG. 1 is a front perspective view of a cleaning device in accordance with the present invention.
Figure 2:
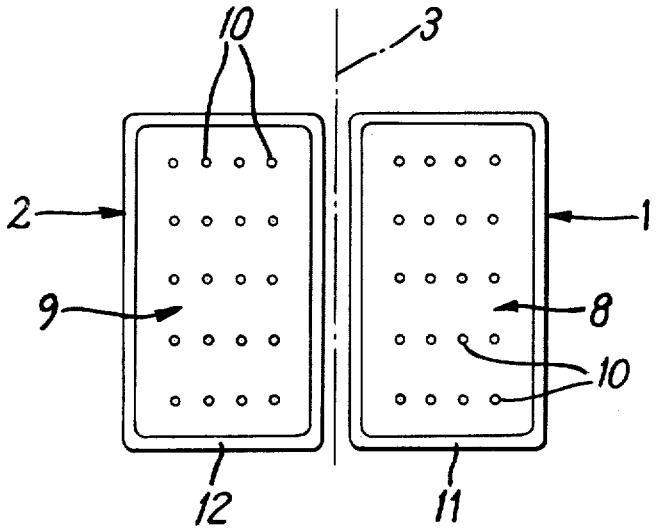
FIG. 2 is a rear view of the cleaning flaps of the device of FIG. 1.

With reference to FIGS. 1 and 2, there are shown two double walled cleaning flaps 1, 2 which are mounted for pivotal movement about a vertical hinge pin 3. The cleaning flaps 1, 2 are pivoted between an open position and a closed position by conventional hydraulic cylinder-and-piston devices 4, 5 attached to an arm mounted transversely to a vertical support column 15.

The vertical support column 15 is provided with an hydraulic adjustment device 16 which may be axially displaced to provide vertical movement of the cleaning flaps 1, 2 relative to the housing 26. The housing 26 has rollers 17 which enable the cleaning device to be moved about in all directions.

Figure 4:
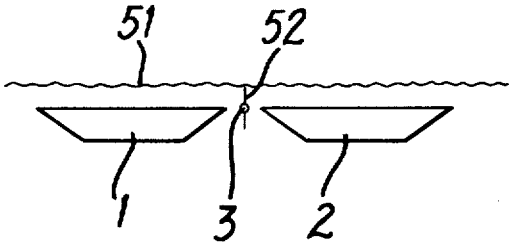
FIGS. 4, 5 and 6 are schematic partial plan views illustrating the operation of the device of FIG. 1.
Figure 6:
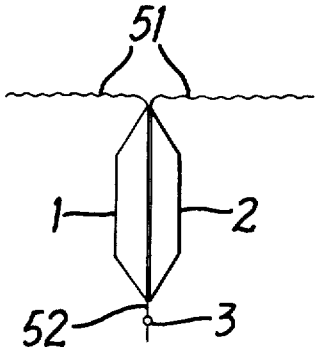
Figure 5:
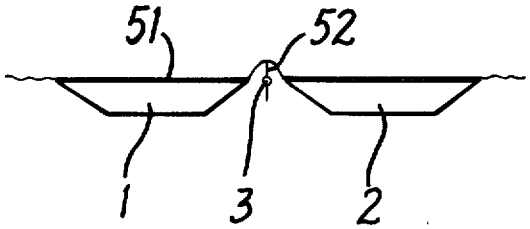

The inner walls 8, 9 of the cleaning flaps 1, 2 are flat, and have a series of holes arranged in parallel rows which function as nozzles 10. The outer peripheral surfaces of the inner walls 8, 9 have seals 11, 12 which are aligned to abut when the flaps 1, 2 are pivoted about the hinge pin 3 to the closed position, so as to space apart the walls 8 and 9 and form a cleaning chamber therebetween. The outer walls 6, 7 of the cleaning flaps 1, 2 have a trapezoid-type shape in cross section, as seen in FIGS. 4–6, to form, with the inner walls 8, 9, a pair of fluid distribution chambers 13, 14.

Figure 3:
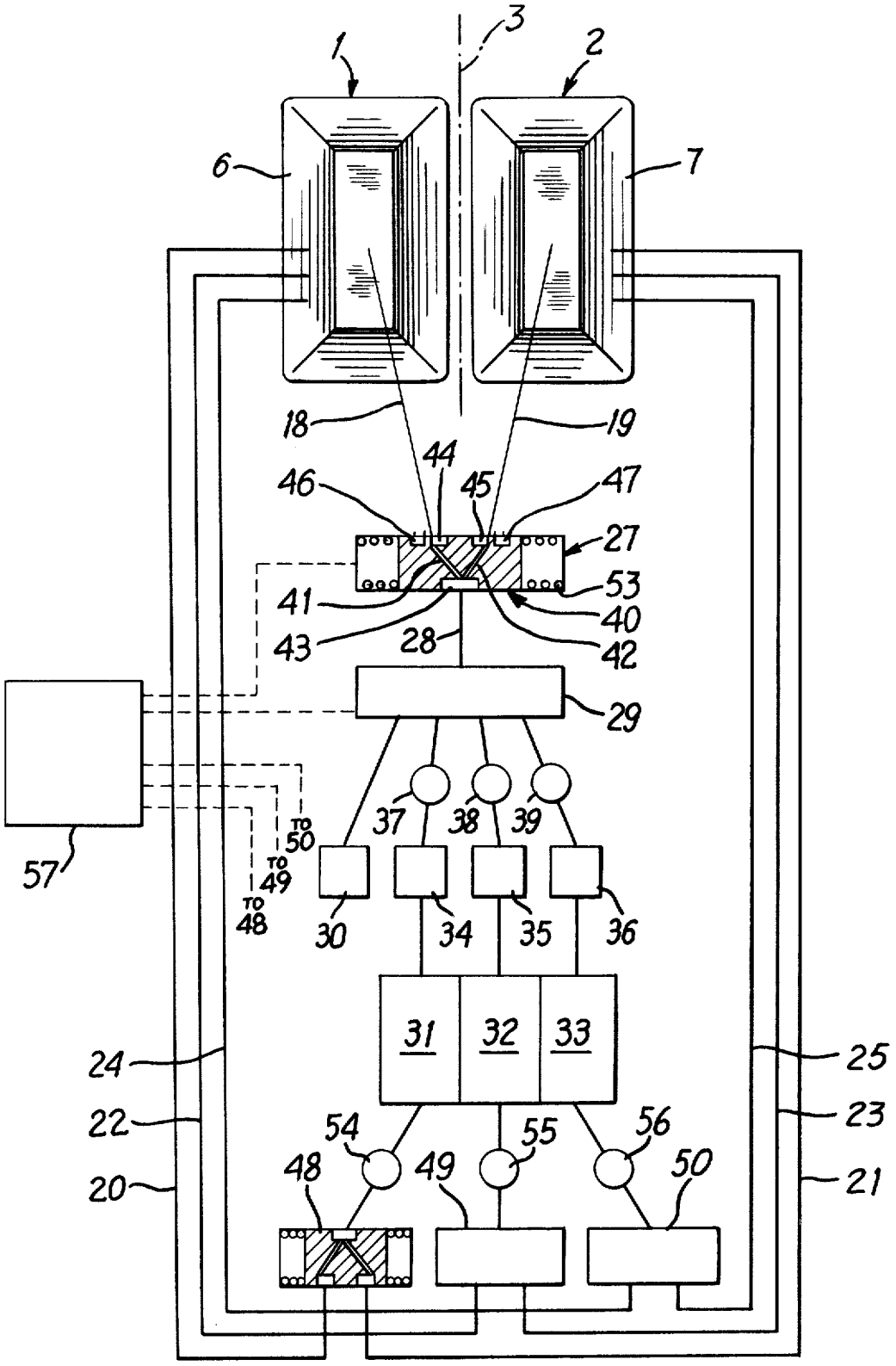
FIG. 3 is a schematic illustration of the air, water and cleaning fluid delivery and discharge arrangements for the cleaning device of FIG. 1.

As shown in FIG. 1 and illustrated schematically in FIG. 3, the distribution chambers 13, 14 are connected via a pair of fluid delivery lines 20, 21 to a water tank 31; via a pair of delivery lines 22, 23 to a lye tank 32; and via delivery lines 24, 25 to a tank of cleaning fluid 33.

Also connected with the distribution chambers 13, 14 is a pair of delivery lines 18, 19 which lead, via the three-position multipath valve 27 described more fully below, into the common fluid return line 28.

The common line 28, which joins delivery lines 18, 19, may be connected selectively, by a valve 29 having a conventional construction such as a slide gate, either to a vacuum source 30 to supply suction during certain operating conditions of the device or, when fluid is being supplied to the flaps 1 and 2 from one of the tanks 31, 32 or 33, to one of various return lines for recirculating fluids back to their respective tanks 31, 32 or 33. In this latter operating mode, the returning fluids are pumped by pumps 37, 38, 39 through respective filters 34, 35, 36 before reaching their respective tanks 31, 32, 33 for recycled use.

The valve 27 comprises a slide gate 40 having conduits 41, 42 arranged in a V-shaped configuration in longitudinal section, and further comprises a port 43 at the bottom of the "V," and ports 44, 45 at the ends of the legs of the "V". Ports 46, 47 are provided adjacent ports 44, 45, respectively, and communicate with atmosphere. Springs 53 define the center position of the slide gate 40. The position of the valve 27 may be shifted electro-magnetically, in a manner in itself known and, therefore, not illustrated.

To clean the hung fabric 51 or the like the housing 26 is placed near the curtains, as shown in FIG. 4, and the cleaning flaps 1, 2 are located adjacent the surface of the fabric 51 at the desired height by operation of the hydraulic adjustment device 16. Once the device is positioned, the pump 54 is actuated to supply water, through lines 20 and 21, to the fluid distribution chambers 13 and 14, where it is sprayed through the nozzles 10 onto the fabric 51 to reduce the air permeability of the fabric 51.

Once the fabric has been sprayed, delivery of water is stopped either by stopping pump 54 or by moving valve 48 to a blocking position. With the valve 27 in its center position, as shown in FIG. 3, valve 29 is actuated to connect common line 28, and thereby the delivery lines 18 and 19, to the vacuum source 30. As shown in FIG. 5, the fabric 51 is pulled against the inner surfaces 8, 9 of the flaps 1, 2 by suction, and held. By subsequent actuation of the cylinder-and-piston devices 4, 5, the cleaning flaps 1, 2 are pivoted about the vertical hinge pin 3 from their approximately 180° starting position until they are folded together, thereby folding the fabric area 51 into and retaining the fabric within the cleaning chamber formed between the flaps 1, 2, as seen in FIG. 6.

A strap 52 is provided to prevent the fabric 51 from protruding through the hinge area to the outside of the cleaning chamber surrounded by the peripheral seals 11, 12. The strap 52 projects downwardly from a horizontal arm on the vertical support column 15 into the cleaning chamber, parallel to the vertical hinge pin 3 and between the seals 11, 12.

Once the cleaning flaps 1, 2 are folded together to define the cleaning chamber, the actual cleaning process begins. At this point the fabric is tightly held by the seals 11, 12, so that the vacuum source is no longer needed to hold the fabric in place. Valve 29 is actuated to disconnect the common line 28 from the vacuum source to connect it instead to pumps 37, 38 or 39 in the return line of one of the tanks, 31, 32 or 33. Water, lye or chemical cleaning fluid is selectively pumped by pump 54, 55 or 56, from the approxmate tank, through one of the pairs of lines 20, 21, or 22, 23 or 24, 25, to the cleaning chamber containing the fabric 51 and thereafter recirculated out of the cleaning chambers back to the respective tank 31, 32 or 33 through lines 18 and 19, line 28 and filter 34, 35 or 36.

With the flaps 1 and 2 closed, the device may also be operated to produce a beating effect on the fabric. Valve 29 is actuated to connect the vacuum source 30 to the common return line 28. In this position the fluid return lines leading to the pumps 37, 38, 39 are disconnected from the common return line 28, and fluid is not pumped from any of the tanks. By shifting the multipath valve 27 from the center position shown towards the right, delivery line 18 is connected to port 46 and thereby to the atmosphere. Line 19, however, remains connected to the vacuum source 30 through ports 45 and 43. Thus air is drawn in through port 46 to flap 1, drawn through the fabric in the cleaning chamber, and suctioned out through flap 2, and line 19. When the valve 27 is shifted to the right, this suctioning operation is reversed. By oscillating valve 27 back and forth, the fabric area in the cleaning chamber is subjected to an alternating, beating-type effect.

Similarly, in the fluid delivery phase, if desired instead of pumping liquid simultaneously to both of the flaps 1, 2 via the appropriate pair of delivery lines, e.g. 20 and 21, the valve 48, 49 or 50 may be oscillated to provide alternating delivery of the fluid through only one of the two lines in the pair.

The structure of the valves 48, 49, 50 is shown only for the valve 48, the structure and operation of the valves 48, 49, 50 being easily understood by those skilled in the art and in light of the description of the multipath valve 27.

The process must be adapted to each individual case, depending on the various factors, e.g., density or degree of soiling of the fabric, and the type of soiling. As explained with reference to FIG. 3, the various fluids are introduced into the fabric selectively on one side, or on both sides, and are removed therefrom through the return lines. After the fabric is cleaned, it may be dried by reconnecting the source of vacuum 30, with or without oscillating valve 27.

Preferably, the overall operation of the device is controlled by an automatic timing and sequencing device 57 of the type known to those skilled in the art relating to conventional washing machines. The controller 57 is connected to the valves 27, 29, 48, 49 and 50, to selectively actuate or de-actuate (to their center positions) the various valves to effect the sequential cleaning steps. The controller 57 may also be connected to the pumps 37, 38, 39, 54, 55 and 56 to turn them on and off as needed, or the pumps may run continuously.

Although the invention has been particularly shown and described with reference to a representative embodiment thereof, it will be understood by those skilled in the art that various modifications and variations of such embodiment may be made without departing from the spirit and scope of the invention. All such modifications and variations, therefore, are intended to be encompassed within the scope of the appended claims.

I claim:

1. A cleaning device for hung fabric and the like comprising a pair of adjacent cleaning flaps, each having an outer wall, an inner wall, and a fluid distribution chamber between the inner and outer walls, hinge means for pivoting said cleaning flaps between a closed position, in which said inner walls are folded together to define a cleaning chamber for tightly retaining a portion of said fabric between said cleaning flaps, and an open position for releasing said fabric, and means for selectively delivering and discharging a plurality of fluids to and from said fluid distribution chambers, wherein each said inner wall has nozzle means communicating with said fluid distribution chambers for delivering and discharging said fluids through said inner wall to and from the fabric.

2. A cleaning device in accordance with claim 1, wherein said means for selectively delivering and discharging said fluids comprise a plurality of pairs of fluid delivery lines, one of the delivery lines of each said pair being connected to one of said distribution chambers.

3. A cleaning device in accordance with claim 2, comprising peripheral sealing means on said inner walls for forming said cleaning chamber when said cleaning flaps are pivoted to said closed position.

4. A cleaning device in accordance with claim 3, comprising spacer means which projects into said cleaning chamber for preventing said fabric from protruding through said hinge means to the outside of said cleaning chamber.

5. A cleaning device in accordance with claim 4, wherein said spacer means comprises a strap extending into said cleaning chamber parallel to said hinge means.

6. A cleaning device in accordance with claims 1 or 2, comprising cylinder-and-piston means for moving said cleaning flaps between said open and closed positions.

7. A cleaning device in accordance with claim 2, comprising a multipath valve interposed in one of said pairs of delivery lines which in a first position connects only one delivery line of said one pair with its respective distribution chamber, and in a second position connects only the other delivery line of said one pair with its respective distribution chamber.

8. A cleaning device in accordance with claim 7, wherein said multipath valve has a third position in which both delivery lines of said one pair are connected with their respective distribution chambers.

9. A cleaning device in accordance with claim 8, wherein said multipath valve connect said one pair of delivery lines to a common fluid delivery line and includes means, in said first and second positions, for venting the unconnected delivery line to atmosphere, and wherein said cleaning device comprises a vacuum source and means for connecting said common line to said vacuum source.

10. A cleaning device in accordance with claim 9, comprising a source of cleaning fluid, means for connecting a second pair of said pairs of delivery lines to said source of cleaning fluid, a first return line connected to said source of cleaning fluid, and wherein said means for connecting said common line to said vacuum source comprises second valve means for selectively connecting said common line to one of said vacuum source and said first return line.

11. A cleaning device in accordance with claim 10, comprising a source of water, means for connecting a third pair of said pairs of delivery lines to said source of water, a second return line connected to said source of water, and wherein said second valve means is adapted for selectively connecting said common line to said second return line.

12. A cleaning device in accordance with claim 11, comprising filter means disposed in each said return line.

13. A cleaning device in accordance with claim 11, comprising automatic sequencing means for controlling the operation of said multipath valve and said second valve means.

14. A cleaning device in accordance with claim 13, wherein said cleaning device comprises a portable unit.

15. A cleaning device in accordance with claim 1, comprising means for vertically supporting said hinge means for adjusting the height thereof.

* * * * *